United States Patent [19]

Saotome

[11] Patent Number: 4,969,562

[45] Date of Patent: Nov. 13, 1990

[54] APPARATUS FOR SUPPRESSING QUAKY MOVEMENTS OF MOBILE TYPE CRANE

[75] Inventor: Yoshimi Saotome, Takasago, Japan

[73] Assignee: Kabushiki Kaisha Kobe Seiko Sho, Kobe, Japan

[21] Appl. No.: 397,192

[22] Filed: Aug. 22, 1989

[30] Foreign Application Priority Data

Apr. 21, 1989 [JP] Japan ..... 1-103251

[51] Int. Cl.[5] ..... B66C 23/56

[52] U.S. Cl. ..... 212/261; 212/182; 212/238; 91/437; 60/413; 60/469

[58] Field of Search ..... 212/146, 182, 203, 211, 212/227, 231, 236, 237, 238, 255, 261, 147; 91/437; 60/413, 469

[56] References Cited

U.S. PATENT DOCUMENTS 4,046,270 9/1977 Baron et al. ..... 60/413
4,085,587 4/1978 Garlinghouse ..... 60/413
4,341,149 7/1982 Dezelan ..... 60/416
4,367,673 1/1983 Krueck et al. ..... 91/437
4,674,638 6/1987 Oliphant ..... 212/261

FOREIGN PATENT DOCUMENTS 707161 4/1965 Canada ..... 60/469

*Primary Examiner*—Joseph F. Peters, Jr.
*Assistant Examiner*—R. B. Johnson
*Attorney, Agent, or Firm*—Oblon, Spivak, McClelland, Maier & Neustadt

[57] ABSTRACT

An apparatus for supressing vibration and quaky movements of a pivotally mounted boom on a mobile crane. The boom is supported for pivotal movement by a hydraulic cylinder which is subjected to abrupt forces when the crane is in motion. A hydraulic circuit is constructed to prevent such forces from damaging the hydraulic cylinder and vehicle body of the crane. The circuit is selectively operative to place the hydraulic cylinder in either a working or travel made. The circuit includes an accumulator and three change-over valves to control the flow of fluid in the hydraulic cylinder during the work and travel modes of operation.

2 Claims, 3 Drawing Sheets

APPARATUS FOR SUPPRESSING QUAKY MOVEMENTS OF MOBILE TYPE CRANE

BACKGROUND OF THE INVENTION

1. Field of the Invention

This invention relates to an apparatus for suppressing vibrations and quaky movements in the travel of mobile or automotive type cranes such as rough terrain cranes.

2. Prior Art

As illustrated in FIG. 3, mobile type cranes generally have a boom 3 pivotally supported on a vehicle body 2 which is supported on driven wheels 1, for pivoting movements about a horizontal shaft 5 through a boom uplifting cylinder 4. With a mobile crane of this type, it is usually experienced that the vehicle body 2 is put in vibrations or quaky movements during travel due to undulations or irregularities on road surfaces or due to abrupt accelerations or decelerations of the vehicle body 2, putting the boom 3 and other attachments also in quaky movements to magnify the vibrations and quaky movements of the vehicle body 2 itself, causing of ride discomfort to the operator on the vehicle.

For the purpose of damping such vibrations in travel, there has been known in the art an apparatus as disclosed in Japanese Laid-Open Patent Application No. 59-182195. As shown in FIG. 4, this prior art apparatus employs a damper mechanism 19 which is built in a boom uplifting cylinder 18, a counter-balancing valve 12 provided in a conduit 13 in communication with an oil chamber 181 which holds the load of the cylinder 18, and an electromagnetic change-over valve 16 and a shuttle valve 15 which are provided between the conduit 13 and a conduit 17 which is connected to the other oil chamber 182 or a conduit 14 which is in communication with a direction control valve 11.

According to the prior art apparatus, if the direction control valve 11 is switched to a boom-up or boom-down position when the change-over valve 16 is in position A, the oil pressure is supplied to the oil chamber 181 or 182 of the cylinder 18 to expand or contract the cylinder 18 for lifting up or down the boom. If the change-over valve 16 is switched to position B, the conduit 13 is communicated with the conduit 17 through the electromagnetic valve 16 and shuttle valve 15, forming a closed circuit through the oil chambers 181 and 182 and the oil chamber 191 of the damper mechanism 19 to thereby suppress quaky movements relative to the vehicle body 2 when the vehicle is in travel.

With this prior art arrangement, even if the change-over valve 16 is returned to position A after a vehicle travel operation with the change-over valve 16 in position B to perform the vibration suppressing function, the ball 151 of the shuttle valve 15 is retained in the right position, which is shown in the drawing, by the load pressure produced in the vehicle travel operation, holding the conduit 14 in closed state and sealing the load pressure in the oil chamber 182.

Therefore, in order to start a crane operation after a vehicle travel, it is required not only to return the change-over valve to position A but also to switch the direction control valve 11 once to a boom-down position to supply the oil pressure from the pump 10 to the conduit 14 to thereby move the ball of the shuttle valve 15 to the left while supplying the oil pressure to the oil chamber 182 through the conduit 17 to contract the cylinder 18 to its stroke end. Thereafter, the direction control valve 11 has to be returned to the neutral position. Needless to say, these resetting operations are very troublesome.

If the direction control valve 11 is directly switched to the boom-up position to start a crane operation, neglecting the above-mentioned boom-up operation, the oil pressure from the pump 10 will be supplied to the oil chamber 181 through the conduit 13 to stretch the cylinder 18. However, at this time, the oil which tends to flow into the conduit 17 from the oil chamber 182 is blocked by the shuttle valve 15, finding no way to flow into the conduit 14 or toward the tank. Namely, the cylinder 18 is stretched in the fashion of a ram cylinder, and a pressure equivalent to the load holding pressure in the oil chamber 181 also prevails in the oil chamber 182. It follows that the effective pressure receiving area of the piston 183 in the oil chamber 181 becomes a small area corresponding to the sectional area of the rod 184, and therefore the load holding pressure in the oil chamber 181 is increased to an abnormally high level. If the load holding pressure exceeds the preset relieving level of the counter-balancing valve 12, an overload relief valve is opened, contracting the cylinder 18 contrary to the operator's intention and causing an abrupt drop of the boom 3 which imposes a great shock on the vehicle body 2.

On the other hand, in order to perform the vibration suppressing function effectively on a mobile type crane, it is necessary to expand the cylinder 4 (denoted at 18 in FIG. 1) slightly from its fully contracted state as shown in FIG. 4, holding the fore end of the boom at an appropriate level from the ground surface, that is to say, at a level higher than a lower limit height $H_0$ and lower than a limit height $H_2$ as stipulated in traffic regulations. That is to say, the appropriate boom height H1 for the vibration suppressing function should be $H_0 < H_1 < H_2$.

In the above-described prior art apparatus, however, if the cylinder 18 is expanded slightly from the fully contracted state after a crane operation to hold the boom at the appropriate height $H_1$ and then the change-over valve 16 is switched to position B to form a closed circuit, the load holding pressure in the oil chamber 181 is led to and accumulated in the oil chamber 191 of the damper mechanism 19, contracting the cylinder 18 in a degree corresponding to the oil compression volume in the oil chamber 191. This causes an abrupt downfall of the boom 3 which imposes a great shock on the vehicle body 2. In addition, the boom 3 is dropped below the appropriate height $H_1$, making it difficult to perform the vibration suppressing function effectively.

SUMMARY OF THE INVENTION

The present invention contemplates to solve the above-mentioned problems or drawbacks, and has as its object the provision of a vibration suppressing apparatus for a mobile type crane, which, when performing a crane operation after a vehicle travel operation, obviates the operations of contracting a boom uplifting cylinder to its stroke end after switching a change-over valve to a working mode position as in the prior art apparatus, namely, which is improved in maneuverability, permitting the operator to start a crane operation such as a boom upturning operation immediately after switching the operation to the working mode and preventing, in a reliable manner, the sudden downfall of the boom as well as imposition of large shocks on the vehicle body.

It is another object of the present invention to provide a vibration suppressing apparatus of the type mentioned above, which can prevent sudden downfalls of the boom or imposition of great shocks on the vehicle body, as experienced with a conventional apparatus when switching the mode of operation from the working mode to the vehicle travel mode, and which can hold the boom at an appropriate height to perform the vibration suppressing function efficiently.

In accordance with the present invention, there is provided an apparatus for suppressing vibrations and quaky movements of a mobile type crane, which essentially includes: a vehicle body supported on driven wheels; a boom pivotally supported on the vehicle body through a hydraulic cylinder for pivoting movements about a horizontal shaft; a direction control valve for selectively supplying discharge oil pressure of a main hydraulic pump to and from a first load-holding oil chamber and an opposing second oil chamber of the hydraulic cylinder; a counter-balancing valve provided between the direction control valve and the hydraulic cylinder; an accumulator provided between the counter-balancing valve and the hydraulic cylinder for suppressing vibrations of the vehicle body; a first change-over valve selectively switchable between a working mode position for blocking oil flow from the first oil chamber to the second oil chamber and a travel mode position for communicating these oil chambers with each other; a second change-over valve selectively switchable between a working mode position for blocking oil flow from the second oil chamber to the accumulator and a travel mode position for communicating the second oil chamber with the accumulator; a main pilot check valve permitting oil flow from the direction control valve to the second oil chamber while blocking oil flow in the reverse direction; and a third change-over valve selectively switchable between a working mode position for applying a pilot pressure from an auxiliary oil pressure source to a valve opening pilot conduit to the main pilot check valve and a travel mode position for communicating the pilot conduit with a tank.

In a preferred form of the invention, the apparatus further includes an auxiliary pilot check valve which is adapted to block outflow of oil to a drain conduit from an accumulator conduit between the second change-over valve and the accumulator while blocking reverse oil flows. The first change-over valve is a pilot change-over valve which is held in the working mode position when the pilot pressure applied from the accumulator conduit between the accumulator and the auxiliary pilot check valve is lower than a preset level and switched to the travel mode position when higher than the preset level; the second change-over valve is an electromagnetic valve which is retained in the working mode position when in a de-energized state and switched to the travel mode position when energized; and the third change-over valve is an electromagnetic valve which is held in the working mode position in a de-energized state for supplying the pilot pressure from the auxiliary pressure source to valve opening pilot conduits between the main pilot check valve and the auxiliary pilot check valve for opening the respective piloted check valves, and switched to the travel mode position in an energized state for communicating the respective pilot conduits with the tank.

With the above-described construction, for starting a crane operation after a vehicle travel operation, the respective change-over valves are switched to the working mode positions, whereupon the communication between the first and second oil chambers of the cylinder is blocked and the main piloted check valve is opened. Therefore, even if the direction control valve is switched to the boom-up position immediately, the cylinder can be expanded normally without taking the form of a ram cylinder. This prevents the unexpected abrupt drop of the boom, the imposition of great shocks on the vehicle body, and overloading damages of the cylinder. Besides, the apparatus of the invention obviates the operation of contracting the cylinder to the stroke end, facilitating the switching operations between the travel and working modes.

In a case employing a pilot-operated change-over valve as the first change-over valve and adding the above-described auxiliary pilot check valve, when the operation is switched to the travel mode after a crane operation, the communication between the first and second oil chambers is blocked until a predetermined pressure has been accumulated in the accumulator although the second oil chamber is in communication with the accumulator, preventing the contraction of the cylinder in an initial phase of the operation immediately after a switch to the travel mode as well as the abrupt downfalls of the boom and imposition of great shocks on the vehicle body. Then, by lifting the boom up or down with the main pilot check valve in closed state, pressure is accumulated in the accumulator and, as soon as the accumulated pressure reaches a preset level, the first change-over valve is switched to the working mode position to form a closed circuit through the two oil chambers and in communication with the accumulator to produce the vibration suppressing effect efficiently.

The above and other objects, features and advantages of the invention will become apparent from the following description and the appended claims, taken in conjunction with the accompanying drawings which show by way of example preferred embodiments of the invention.

DESCRIPTION OF PREFERRED EMBODIMENTS

Figure 1:
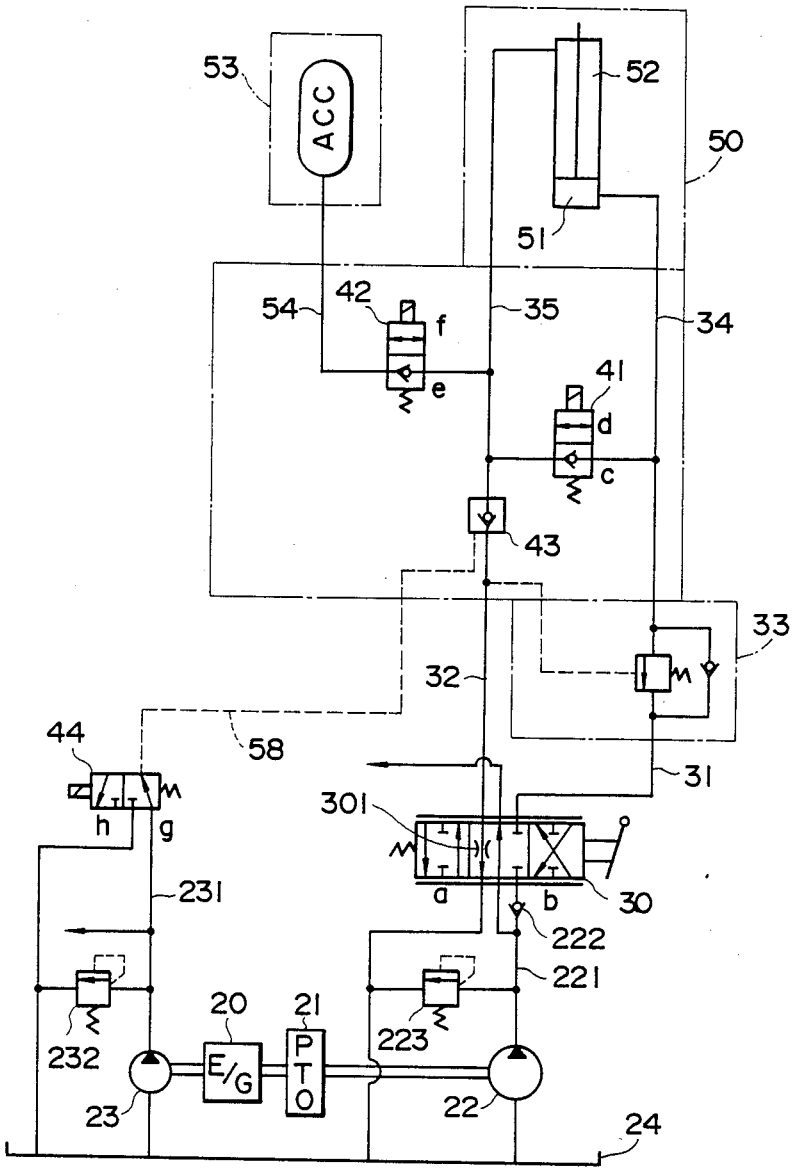
FIG. 1 is a hydraulic circuit diagram in an embodiment of the present invention.
Figure 3:
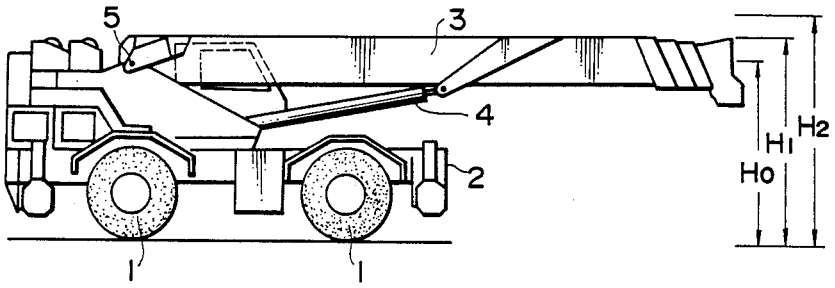
FIG. 3 is a schematic sectional view of a mobile type crane.
Figure 4:
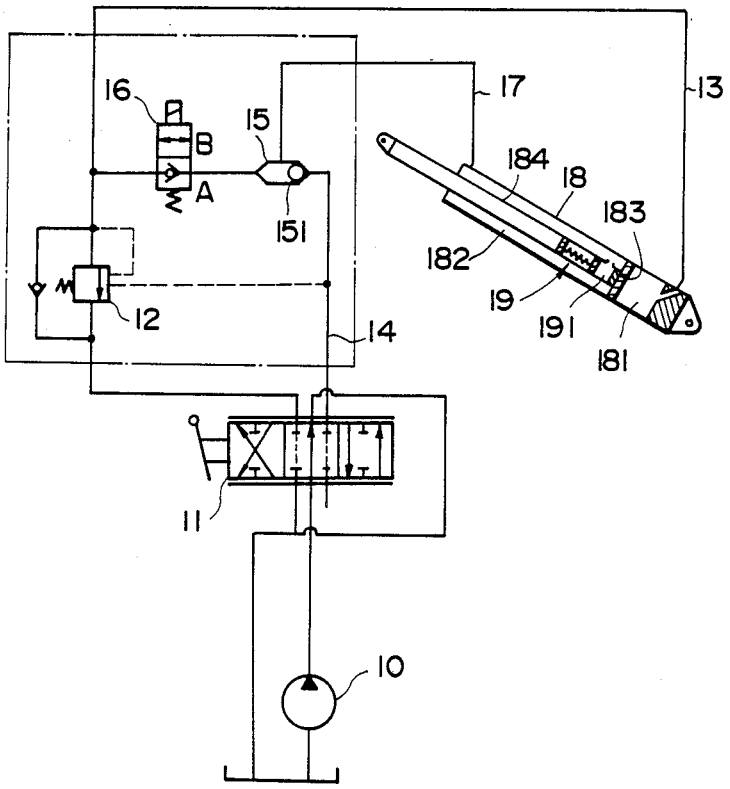
FIG. 4 (PRIOR ART)
FIG. 4 is a hydraulic circuit diagram in a conventional apparatus.

Referring to FIG. 1, there is illustrated an embodiment of the present invention, wherein indicated at 20 is an engine which is mounted on a mobile type crane as shown in FIG. 3. A main hydraulic pump 22 is coupled with the engine 20 through a power transmission mechanism (PTO) while an auxiliary hydraulic pump 23 is directly coupled with the engine 20. Connected to a conduit 221 on the discharge side of the main pump 22 are a check valve 222 and a main relief valve 223. The conduit 221 is also communicable with the opposite oil chambers 51 and 52 of a boom uplifting hydraulic cylinder 50 (corresponding to the cylinder 4 in FIG. 3) through direction control valve 30, conduits 31 and 32, counter-balancing valve 33, main pilot check valve 43 and conduits 34 and 35.

A first change-over valve 41 is selectively switchable between position c for blocking oil flow from the conduit 34 to conduit 35 while permitting reverse oil flow, and position d for communicating the conduits 34 and 35 with each other. A second change-over valve 42 is selectively switchable between position e for permitting oil flow from conduit 54 to conduit 35 while blocking reverse oil flow, and position f for communicating the conduits 35 and 54 with each other. The main pilot check valve 43 is oriented in such a manner as to permit oil flow from conduit 32 to conduit 35 while blocking reverse oil flow, and opened when a pilot pressure is drawn into a conduit 58. A third change-over valve 44 is selectively switchable between position g for communicating a conduit 231, connected to the auxiliary hydraulic pump 23 (an auxiliary pressure source), with the pilot conduit 58, and position h for communicating the conduit 58 with the tank.

Each of the change-over valves 41, 42 and 44 is constituted by an electromagnetic change-over valve and switchable by turning on or off a mode selector switch which is provided in the operator's cabin.

When the mode selector switch is turned off (working mode), the solenoids of the change-over valves 41, 42 and 44 are de-energized to hold the change-over valves in the working mode positions c, e and g, respectively. If the engine 20 is actuated in this state, the pump 23 is driven and the discharge oil pressure of the auxiliary pump 23 is supplied to the pilot conduit 58 to open the pilot check valve 43. On the other hand, the main pump 22 is driven upon turning on the transmission mechanism 21.

Now, if the direction control valve 30 is switched to boom-up position a, the discharge oil pressure of the main pump 22 is supplied to one oil chamber 51 through the counter-balancing valve 33 to expand the cylinder 50. At this time, the main pilot check valve is in a closed state, so that the oil which flows out of the other oil chamber 52 with the expansion of the cylinder 50 is returned to the tank 24 past the pilot check valve 43 and through the direction control valve 30. If the direction control valve is switched to boom-down position b, the discharge oil of the main pump 22 flows conversely into the oil chamber 52 through the main pilot check valve 43 and, while contracting the cylinder 50, the counter-balancing valve 33 is opened depending upon the inflowing pressure to return the oil pressure in the oil chamber 51 to the tank.

By expansion and contraction of the cylinder 50, the boom 3 of FIG. 3 is turned up and down about the pivotal shaft 5 for boom uplifting and lowering operations. In such a working operation, the main pilot check valve 43 is open, so that there is no possibility of the cylinder becoming a ram cylinder. Besides, since the first change-over valve 41 is retained in position c, the oil in the load-holding oil chamber 51 of the cylinder 50 and the high pressure oil in the conduit 34 by no means flow into the other oil chamber 52 of the cylinder. Further, since the second change-over valve 42 is in position e, the oil in the conduit 35 would not flow into the accumulator. Accordingly, the cylinder 50 never becomes a ram cylinder, precluding the possibility of its load-holding pressure rising to an abnormally high level. In lifting the boom up or down the oil pressure is fed to the oil chamber 51 or 52 of the cylinder 50 appropriately at a rate commensurate with the extent of shift (spool open area) of the direction control valve 30, free of the interference by the accumulator 53.

Now, in order to start the vehicle, the boom 3 is contracted substantially into a fully contracted state by means of a boom stretching cylinder, which is not shown, in the working mode (with the mode selector switch off), and then the cylinder 50 (denoted at 4 in FIG. 3) is expanded slightly from a fully contracted state to raise the boom 3 slightly from the lower limit height, namely, to hold the fore end of the boom at an appropriate travel height H1 from the ground surface, and the direction control valve 30 is returned to the neutral position. On the other hand, after removing a suspended load if any, the crane hook (not shown) is securely anchored on the vehicle body with a suitable degree of versatility. Thus, the boom 3 is held in a state suitable for vehicle travel.

As the mode selector switch is turned on (vehicle travel mode), the solenoids of the respective change-over valves 41, 42 and 44 are energized to shift them to positions d, f and h (travel mode positions). As a result, the conduit 58 is communicated with the tank 24 through the third change-over valve 44 in position h, and the main pilot check valve 43 is closed to block oil flow from the conduit 35 to conduit 32. The conduit 35 is communicated with the conduit 54 or the accumulator 53 through the second change-over valve 42 in position f. On the other hand, the oil flow from the conduit 34 to conduit 31 is blocked by the counter-balancing valve 33, and the conduits 34 and 35 are communicated with each other through the first change-over valve 41 in position d. In this manner, a closed circuit is formed through the opposing oil chambers 51 and 52 of the cylinder 50 and in communication with the accumulator 53.

In this instance, the change-over valves 41, 42 and 43 may be switched simultaneously to lead the load-holding pressure in the oil chamber 51 of the cylinder 50 to the accumulator 53 for accumulation in the latter. However, it is possible to prevent contraction of the cylinder 50 in an initial phase of the vehicle travel mode operation by switching the change-over valves with a time lag and in the order of the third, second and first change-over valves 44, 42 and 41, thereby closing the main pilot check valve 43 and communicating the conduit 35 with the accumulator, and then switching the direction control valve 30 into a boom-up or boom-down position to supply the pressure oil to the conduit 34 or 35 at an appropriate rate while holding the first change-over valve 41 still in position c to accumulate pressure in the accumulator up to a level equivalent to the load-holding pressure in the oil chamber 51, and then switching the first change-over valve 41 to position d.

Next, a vehicle drive mechanism is actuated to drive the wheels 1. In the vehicle travel operation, the vibrations of the vehicle body 2 caused by undulations or irregularities on road surfaces and accelerations and decelerations of the vehicle are usually accompanied by vertical quaky movements of the boom 3 which telescopically stretch and contract the cylinder 50. On such an occasion, since the opposite oil chambers 51 and 52 of the cylinder 50 communicated with each other and with the accumulator 53, the pressure fluctuations resulting from the telescopic motions of the cylinder 50 are suppressed by vibration suppressing actions of the accumulator 53 and the pressure losses in the conduits of the closed circuit, as a result suppressing the vibrations and displacements of the vehicle body 2 to improve the comfort of ride on the vehicle. In the vehicle travel operation, the transmission mechanism 21 is in an off state and the main hydraulic pump 22 is at rest, contributing to energy saving. Although the auxiliary hydraulic pump 23 is constantly driven from the engine 20, its discharge oil pressure is utilized as a pressure source for clutches or brakes without being supplied to the accumulator.

On the other hand, the engine 20 is once stopped in the course of the vehicle travel operation, for example, at a gas station for refilling fuel, the change-over valves 41, 42 and 44 are all returned to positions c, e and g (working mode positions) communicating the conduits 231 and 58 with each other. At this time, however, the pump 23 is also at rest and the main pilot check valve 43 is closed, so that the accumulated oil pressure would not flow out toward the tank 24 from the accumulator 53, and the boom 3 is held at the appropriate travel height H1. Accordingly, when resuming the vehicle travel operation afterwards, there is no need for accumulating pressure freshly in the accumulator 53. The vehicle can be put in travel again simply by turning on the power switch and the mode selector switch and re-starting the engine 20, thus requiring only a simple procedure for resuming the vehicle travel operation.

In order to carry out a crane operation after a vehicle travelling operation, the mode selector switch is turned off (working mode) and then the transmission mechanism 21 is turned on to drive the main pump 22. In this instance, as soon as the mode selector switch is turned off, the change-over valves 41, 42 and 44 are returned to positions c, e and g (working mode positions), opening the main pilot check valve 43 and opening the conduit 35 by communication with the conduit 32 while communicating the conduit 54 with the conduit 35 to drain the accumulated pressure from the accumulator 53 to the tank 24 through a throttle 301 of the direction control valve 30 until the accumulator pressure becomes in level with the tank pressure. Accordingly, in contrast to the conventional counterpart, there is no need for carrying out a boom lowering operation after switching the mode of operation to the working mode. Namely, even if a boom uplifting operation is carried out immediately after switching the mode of operation, the cylinder 50 is operated normally without forming a ram cylinder. Consequently, there are no possibilities of the boom falling down abruptly regardless of the operator's intention or imposing a great shock on the vehicle body or of the cylinder being damaged by overloading. It follows that the crane operations including a boom uplifting operation can be carried out smoothly.

Figure 2:
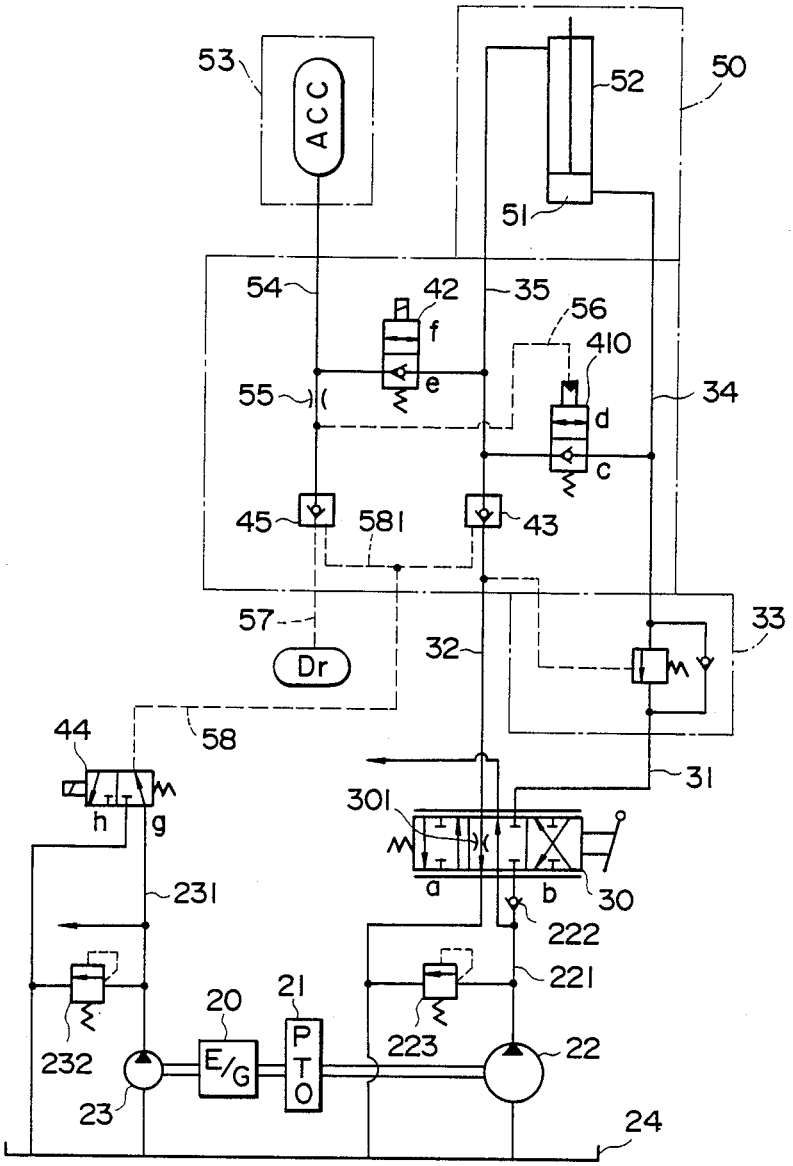
FIG. 2 is a hydraulic circuit diagram in another embodiment of the invention.

Illustrated in FIG. 2 is another embodiment of the invention, in which a piloted change-over valve (the first change-over valve) 410 is employed in place of the electromagnetic change-over valve 41 of FIG. 1. This change-over valve 410 is held in position c when the accumulated pressure of the accumulator 53, drawn into conduit 56, is lower than a predetermined level, and switched to position d when higher than the predetermined level. An auxiliary pilot check valve 45 is oriented to block oil flow from the accumulator conduit 54 to drain conduit 57, and permit reverse oil flow, and opened when a pilot pressure is supplied to conduit 581 which is in communication with a pilot conduit 58. The reference numeral 55 denotes a throttle. In other respects, the construction is substantially the same as the first embodiment shown FIG. 1.

According to the embodiment of FIG. 2, the mode selector switch is turned off in a crane operation. In this state, the change-over valves 42 and 44 are retained in positions e and g, respectively, and both of the pilot check valves 43 and 45 are open, with the accumulated pressure of the accumulator 53 drained through the auxiliary pilot check valve 45 and held in level with the tank pressure. The first change-over valve 410 is retained in position c. If the direction control valve 30 is switched to a boom-up or boom-down position under these circumstances, the oil pressure is separately supplied to and drained from the respective oil chambers of the cylinder 50, telescopically stretching or contracting the cylinder 50 for the boom-up or boom-down operation in a normal fashion without forming a ram cylinder.

Now, in order to move the vehicle, the boom 3 is set in the appropriate travel position in the same manner as described hereinbefore in connection with the embodiment of FIG. 1, and then the mode selector switch is turned on (travel mode), whereupon the change-over valves 42 and 44 are switched to positions f and h, respectively, closing the pilot check valves 43 and 45 and communicating the conduits 35 and 54 with each other. The accumulated pressure of the accumulator 53, however, remains at the level of the tank pressure, and the first change-over valve 410 remains in position c. As a result, outflow of oil from the conduit 34 to conduit 35 is blocked by the first change-over valve 410 in position c, while outflow of oil from the conduit 34 to conduit 31 is blocked by the counter-balancing valve 33. Therefore, the boom is retained in the initially set position without being deviated by the contraction of the cylinder 50. Thus, the contraction of the cylinder and the abrupt downfall of the boom 3 in the initial stage of operation immediately after a switch to the travel mode can be prevented in a secure manner.

Thereafter, the direction control valve 30 is switched to the boom-up or boom-down position, supplying the oil pressure from the pump 22 to the conduit 34 or 35 at a suitable rate to accumulate pressure in the accumulator 53 up to a level equivalent to the load-holding pressure in the oil chamber 51. As soon as a pressure equivalent to the load-holding pressure is reached, the first change-over valve 410 is switched to position d to communicate the conduits 34 and 35 in a closed circuit which is in communication with the accumulator 53. In this case, it is also after a pressure equivalent to the load-holding pressure in the oil chamber 51 has been accumulated in the accumulator 53 that the conduits 34 and 35 are communicated with each other, preventing the contraction of the cylinder 50 or abrupt downfall of the boom 3 which would otherwise take place when the mode of operation is switched.

Further, when re-starting the vehicle after once stopping the engine and turning off the power switch midway of a vehicle travel operation, similarly to the foregoing embodiment, it suffices to turn on the power switch and the mode selector switch to actuate again the engine 20. Since there is no need for freshly accumulating pressure in the accumulator, the vehicle can be re-started in an extremely facilitated manner.

Further, in order to carry out a crane operation after a vehicle travel operation, the mode switch is turned off, whereupon the change-over valve 42 and 45 are returned to positions e and g (working mode positions), respectively, opening the pilot check valves 43 and 45 to open the conduit 35 into communication with the conduit 32, and communicating the pilot conduit 56 with the drain conduit 57 to return the change-over valve 410 to position c. The accumulator conduit 54 is communicated with the conduit 57 through the throttle 54 and pilot check valve 45, draining the accumulated oil pressure in the accumulator 53 to the tank 24 through the throttle 55 or the throttle 301 of the direction control valve 30.

Therefore, it is not necessary to carry out a boom lowering operation after switching the operation to the working mode, which is required in the conventional apparatus as described hereinbefore. Similarly to the foregoing embodiment, even if the boom is uplifted immediately after the switch to the working mode, the cylinder 50 is operated normally without forming a ram cylinder, precluding the possibilities of unexpected abrupt downfalls of the boom, imposition of large shocks on the vehicle body and overloading rupture of the cylinder 50. Thus, the crane operations including boom uplifting operations can be performed smoothly.

It will be appreciated from the foregoing description that, according to the present invention, when carrying out a crane operation after a vehicle travel operation, the first and second oil chambers of the cylinder are separated independently of each other in a secure manner simply by switching the respective change-over valves into working mode positions, and the cylinder can be expanded in normal state or without forming a ram cylinder even if the direction control is switched to the boom-up position immediately after switching the mode of operation. This prevents the boom from abruptly dropping regardless of the operator's intention or imposing large shocks on the vehicle body, at the same time precluding overloading damages of the cylinder. Besides, the construction of the invention obviates the operation of contracting the cylinder to its stroke end, facilitating the switching operation to the working mode from the vehicle travel mode while enhancing maneuverability of the machine.

The above-described embodiment employing a piloted change-over valve as the first change-over valve in combination with an auxiliary piloted check valve suitably prevents the contraction of the cylinder which would otherwise occur in an initial phase of operation when the operation mode is switched to the travel mode after a crane operation, preventing in a secure manner the abrupt downfall of the boom and imposition of great shock on the vehicle body. If thereafter a boom uplifting or lowering operation is carried out with the main piloted check valve in closed state to accumulate a predetermined pressure in the accumulator, the first change-over valve can be automatically switched to the vehicle travel mode, communicating the two oil chambers with each other by a closed circuit in communication with the accumulator to produce the displacement suppressing effect efficiently during the vehicle driving operation.

What is claimed is:

1. An apparatus for suppressing vibrations and quaky movements of a mobile type crane, comprising:

a vehicle body supported on driven wheels;

a boom pivotally supported on said vehicle body through a hydraulic cylinder for pivoting movements about a horizontal shaft;

a direction control valve for selectively supplying discharge oil pressure of a main hydraulic pump to and from a first load-holding oil chamber and an opposing second oil chamber of said hydraulic cylinder;

a counter-balancing valve provided between said direction control valve and said hydraulic cylinder;

an accumulator provided between said counter-balancing valve and said hydraulic cylinder for suppressing vibrations of said vehicle body;

a first change-over valve selectively switchable between a working mode position for blocking oil flow from said first oil chamber to said second oil chamber and a travel mode position for communicating said oil chambers with each other;

a second change-over valve selectively switchable between a working mode position for blocking oil flow from said second oil chamber to said accumulator and a travel mode position for communicating said second oil chamber with said accumulator;

a main piloted check valve permitting oil flow from said direction control valve to said second oil chamber while blocking oil flow in the reverse direction; and a third change-over valve selectively switchable between a working mode position for applying a pilot pressure from an auxiliary oil pressure source to a valve opening pilot conduit leading to said main piloted check valve and a travel mode position for communicating said pilot conduit with a tank.

2. An apparatus as defined in claim 1, further comprising an auxiliary piloted check valve adapted to block outflow of oil to a drain conduit from an accumulator conduit between said second change-over valve and said accumulator while blocking reverse oil flows; wherein said first change-over valve is a piloted change-over valve adapted to be held in said working mode position when the pilot pressure applied from said accumulator conduit between said accumulator and said auxiliary pilot check valve is lower than a preset level and switched to said travel mode position when higher than said preset level; said second change-over valve is an electromagnetic valve adapted to be retained in said working mode position when in a de-energized state and switched to said travel mode position when energized; and said third change-over valve is an electromagnetic valve adapted to be held in said working mode position in a de-energized state for supplying said pilot pressure from said auxiliary pressure source to valve opening pilot conduits between said main pilot check valve and said auxiliary pilot check valve for opening the respective pilot check valves, and switched to said travel mode position in energized state for communicating the respective pilot conduits with said tank.

* * * * *

UNITED STATES PATENT AND TRADEMARK OFFICE

CERTIFICATE OF CORRECTION

PATENT NO. : 4,969,562

DATED : NOVEMBER 13, 1990

INVENTOR(S) : YOSHIMI SAOTOME

It is certified that error appears in the above-identified patent and that said Letters Patent is hereby corrected as shown below:

On the title page, in item [22]:

Please delete "August 22, 1989" and insert --August 23, 1989--.

Signed and Sealed this

Seventh Day of April, 1992

*Attest:*

HARRY F. MANBECK, JR.

*Attesting Officer*

*Commissioner of Patents and Trademarks*